US009476630B2

(12) United States Patent
Andochick

(10) Patent No.: US 9,476,630 B2
(45) Date of Patent: Oct. 25, 2016

(54) METHOD AND APPARATUS FOR WATER STORAGE AND TRANSPORT

(71) Applicant: Scott E. Andochick, Potomac, MD (US)

(72) Inventor: Scott E. Andochick, Potomac, MD (US)

( * ) Notice: Subject to any disclaimer, the term of this patent is extended or adjusted under 35 U.S.C. 154(b) by 442 days.

(21) Appl. No.: 14/215,324

(22) Filed: Mar. 17, 2014

(65) Prior Publication Data

US 2014/0196477 A1 Jul. 17, 2014

Related U.S. Application Data

(62) Division of application No. 12/416,561, filed on Apr. 1, 2009, now Pat. No. 8,672,544.

(51) Int. Cl.

| | |
|---|---|
| ***F25C 1/00*** | (2006.01) |
| ***F25C 1/22*** | (2006.01) |
| ***B65D 37/00*** | (2006.01) |
| ***B65D 75/48*** | (2006.01) |
| ***B65D 75/52*** | (2006.01) |
| ***B65D 75/56*** | (2006.01) |
| ***B65D 75/58*** | (2006.01) |
| ***B65D 75/42*** | (2006.01) |

(52) U.S. Cl.

CPC ..... *F25C 1/22* (2013.01); *B65D 37/00* (2013.01); *B65D 75/42* (2013.01); *B65D 75/48* (2013.01); *B65D 75/527* (2013.01); *B65D 75/56* (2013.01); *B65D 75/5816* (2013.01); *B65D 75/5877* (2013.01)

(58) Field of Classification Search

CPC ..... F25C 2400/06; F25C 1/22; F25C 1/225; B65D 37/00; B65D 75/56

See application file for complete search history.

(56) References Cited

U.S. PATENT DOCUMENTS

| | | | |
|---|---|---|---|
| 747,634 | A | 12/1903 | Peterson |
| 1,603,001 | A | 10/1926 | Carter |
| 1,650,764 | A | 11/1927 | Menalio |
| 2,194,451 | A | 3/1940 | Soubier |
| 2,220,873 | A | 11/1940 | Waters |
| 2,647,680 | A | 7/1948 | Vogt |
| 2,934,122 | A | 4/1960 | Lindsey |
| 3,008,835 | A | 11/1961 | Madding |
| 3,030,003 | A | 4/1962 | Schanzle |
| 3,231,901 | A | 2/1966 | Kennedy |
| 3,358,821 | A | 12/1967 | Weisberg |
| 3,490,576 | A | 1/1970 | Alessi et al. |
| 3,537,628 | A | 11/1970 | Thompson |
| 3,559,874 | A | 2/1971 | Tichenal |

(Continued)

FOREIGN PATENT DOCUMENTS

| | | |
|---|---|---|
| IT | 12418998 | 2/1994 |
| WO | WO2007059643 | 5/2007 |

OTHER PUBLICATIONS www.prolitegear.com, Hydration products pages, Feb. 1, 2004 according to www.archive.org.

*Primary Examiner* — Orlando Aviles Bosques

(74) *Attorney, Agent, or Firm* — Leveque Intellectual Property Law, P.C.

(57) ABSTRACT

A method and apparatus for water storage and transport uses a container constructed from one of more flexible plastic sheets. A number of chambers for holding water are formed within the container. Each chamber is separated from an adjacent chamber by a web of the flexible plastic sheet. The web of the flexible plastic sheet is perforated to allow adjacent chambers to be separated from one another. In use, the water in the chambers may be liquid or frozen.

10 Claims, 3 Drawing Sheets

(56) References Cited

U.S. PATENT DOCUMENTS

| | | | |
|---|---|---|---|
| 3,669,276 | A | 6/1972 | Woods |
| 3,674,135 | A | 7/1972 | Simon |
| 3,779,449 | A | 12/1973 | Membrino |
| 3,791,573 | A | 2/1974 | Titchenal et al. |
| 3,809,224 | A | 5/1974 | Greenwood |
| 4,090,650 | A | 5/1978 | Gotta |
| 4,139,130 | A | 2/1979 | Glusker et al. |
| 4,176,772 | A | 12/1979 | Danon |
| 4,265,381 | A | 5/1981 | Muscatell |
| 4,433,783 | A | 2/1984 | Dickinson |
| 4,566,507 | A | 1/1986 | Rauchwerger |
| 4,598,421 | A | 7/1986 | Jostler |
| 4,634,031 | A | 1/1987 | Frankhouse |
| 4,685,148 | A | 8/1987 | Titchenal |
| 4,733,817 | A | 3/1988 | Makowka |
| 4,768,688 | A | 9/1988 | Harrigan |
| 4,793,533 | A | 12/1988 | Yang |
| 4,813,792 | A | 3/1989 | Belmont et al. |
| 4,818,544 | A | 4/1989 | Seward |
| D302,874 | S | 8/1989 | Bossart |
| 4,863,285 | A | 9/1989 | Claxton |
| D304,546 | S | 11/1989 | Cattach |
| 4,911,562 | A | 3/1990 | Mazzeschi |
| 4,943,168 | A | 7/1990 | Berg et al. |
| 4,951,940 | A | 8/1990 | Vitello et al. |
| 4,988,097 | A | 1/1991 | Smith et al. |
| 5,074,300 | A | 12/1991 | Murphy |
| 5,107,859 | A | 4/1992 | Alcorn et al. |
| 5,112,138 | A | 5/1992 | Peppiatt |
| 5,115,947 | A | 5/1992 | McDonnell et al. |
| 5,121,995 | A | 6/1992 | Newman et al. |
| 5,131,553 | A | 7/1992 | Geasland |
| 5,167,354 | A | 12/1992 | Cohanfard |
| 5,188,266 | A | 2/1993 | Loulias |
| 5,207,362 | A | 5/1993 | Janus et al. |
| D340,582 | S | 10/1993 | Pressentin |
| 5,282,557 | A | 2/1994 | McCook |
| 5,282,687 | A | 2/1994 | Yee |
| D352,359 | S | 11/1994 | Vorhis |
| 5,377,833 | A | 1/1995 | Ranger |
| 5,431,308 | A | 7/1995 | Tchen |
| 5,571,260 | A | 11/1996 | Krug |
| 5,595,069 | A | 1/1997 | Gies |
| D378,022 | S | 2/1997 | Chen |
| 5,732,862 | A | 3/1998 | Bull |
| 5,759,569 | A | 6/1998 | Hird et al. |
| D396,630 | S | 8/1998 | Lerner |
| 5,971,613 | A | 10/1999 | Bell |
| 5,979,707 | A | 11/1999 | Bodin et al. |
| 5,984,145 | A | 11/1999 | McAllister |
| 5,996,800 | A | 12/1999 | Pratt |
| 6,000,848 | A | 12/1999 | Massioui |
| 6,004,033 | A | 12/1999 | Cirone |
| 6,076,967 | A | 6/2000 | Beaudette |
| 6,176,394 | B1 | 1/2001 | Shimko et al. |
| 6,422,753 | B1 | 7/2002 | Thomas |
| 6,586,060 | B2 | 7/2003 | Kose et al. |
| 6,598,770 | B2 | 7/2003 | Bolts |
| 6,619,843 | B2 | 9/2003 | Harmanoglu |
| 6,626,333 | B2 | 9/2003 | Levesque et al. |
| 6,669,016 | B1 | 12/2003 | Carson |
| 6,695,757 | B2 | 2/2004 | Edwards et al. |
| 6,805,261 | B1 | 10/2004 | Laudenberg |
| 6,837,472 | B1 | 1/2005 | Beutz |
| 6,880,714 | B2 | 4/2005 | Blachester |
| D517,314 | S | 3/2006 | Moyer |
| 7,036,986 | B2 | 5/2006 | Matsuda et al. |
| 7,160,028 | B1 | 1/2007 | Linday |
| 7,284,681 | B2 | 10/2007 | Hagihara |
| 7,329,069 | B2 | 2/2008 | Slater et al. |
| 7,357,276 | B2 | 4/2008 | Savage et al. |
| D573,037 | S | 7/2008 | Murray |
| D580,749 | S | 11/2008 | Miller |
| D580,782 | S | 11/2008 | Murray |
| 7,810,667 | B2 | 10/2010 | Douglas et al. |
| 2001/0005435 | A1 | 6/2001 | Harmanoglu |
| 2002/0176639 | A1 | 11/2002 | Crawley |
| 2003/0102239 | A1* | 6/2003 | Beard ..... B65D 75/42 206/440 |
| 2005/0061831 | A1 | 3/2005 | Brown et al. |
| 2005/0063618 | A1 | 3/2005 | Lorsch |
| 2005/0189385 | A1 | 9/2005 | Dreyer et al. |
| 2005/0265636 | A1 | 12/2005 | Michalsky |
| 2006/0233467 | A1 | 10/2006 | Mize, Jr. |
| 2006/0255006 | A1 | 11/2006 | Wagenknecht et al. |
| 2007/0095831 | A1 | 5/2007 | Thatcher |
| 2007/0108238 | A1 | 5/2007 | Kirker |
| 2007/0140597 | A1 | 6/2007 | Ozdenger Donovan et al. |
| 2008/0226200 | A1 | 9/2008 | Murray |
| 2010/0032458 | A1 | 2/2010 | Shitaye |
| 2010/0086239 | A1 | 4/2010 | Latour |
| 2010/0159096 | A1 | 6/2010 | Sam |
| 2010/0192998 | A1 | 8/2010 | Villers et al. |
| 2010/0252562 | A1 | 10/2010 | Andochick |
| 2010/0254633 | A1 | 10/2010 | Andochick |

* cited by examiner

METHOD AND APPARATUS FOR WATER STORAGE AND TRANSPORT

This application is a divisional application of co-pending application Ser. No. 12/416,561 filed on Apr. 1, 2009, the entire disclosure of which is incorporated into this application by reference and to which the instant application claims priority.

BACKGROUND

Commonly, potable water is distributed to the consumer in plastic or glass bottles of various sizes and shapes, whereas ice is distributed in blocks or in individual plastic bags.

Distribution of water in bottles has a number of disadvantages. Firstly, when the bottles are empty they tend to retain their shape, thus creating a large volume of waste material. Secondly, bottles tend to crack or split if the water in them is frozen, since water expands as it cools. Bottles are therefore not suited to the distribution of ice.

In some situations, such as when emergency relief is needed at a particular location, there is often a need for both ice and water. Ice may be needed for a variety of purposes, included the preservation of perishable foods and for personal cooling, while water is required for hydration. In such situations, those seeking relief must carry unwieldy containers of water (either large containers or multiple bottles) as well as bags or blocks of ice.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
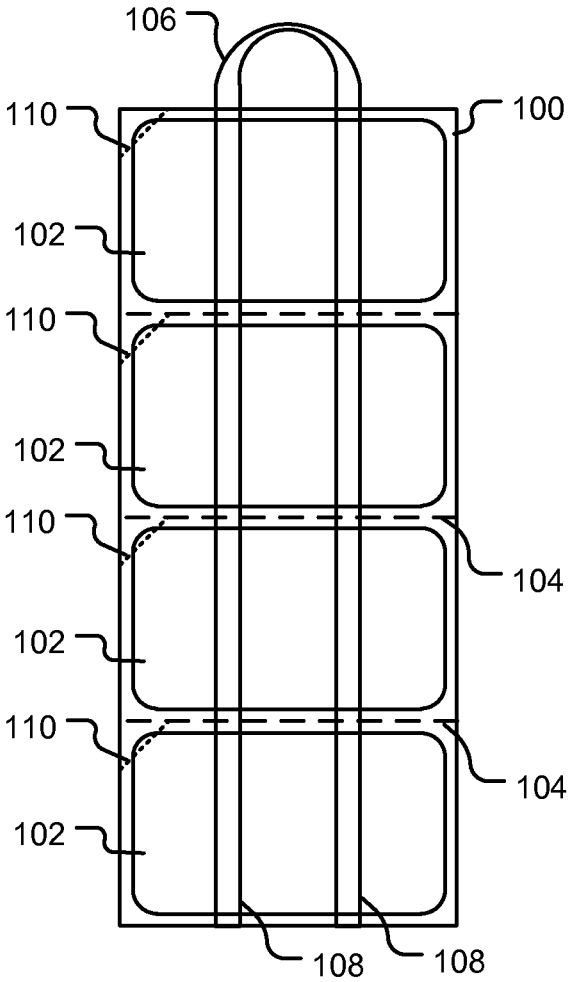
FIG. 1 is a first view of an exemplary water container in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to water (frozen or liquid) storage and transport. Accordingly, the apparatus components and method steps have been represented, where appropriate, by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a first view of an exemplary apparatus for water storage and transport in accordance with some embodiments of the invention. Referring to FIG. 1, the apparatus include a container 100 constructed from one of more flexible plastic sheets. The container comprises a number of connected bags. Each bag has a chamber 102 for holding water. Each chamber is separated from an adjacent chamber by a web of the flexible plastic sheet. The webs have perforations 104 that allow adjacent bags to be separated from one another. It is noted that the one or more flexible plastic sheets of container 100 are flexible to permit holding water or ice within the chambers 102 without leakage. This represents an advantage over the rigid water bottles of the prior art, which crack as water freezes and expands.

In the embodiment shown in FIG. 1, the chambers are arranged in a strip. A loop of flexible material 106 is attached to the container 100 to form a carrying handle. As show, the loop of flexible material has an extended portion 108 that passes down a first side of the container and up a second side of the container, such that, when the apparatus is carried, the weight of water in the chambers is supported, at least in part, by the loop of flexible material. In an alternative embodiment, the loop of flexible material is only connected to the bag at one end of the container.

The loop of flexible material may be removably attached to the container. For example, the loop could be attached to the container using a low strength adhesive that allows the loop to be 'peeled' from the container when it is no longer needed.

The container and the loop may be constructed of thermoplastic. In one embodiment, the container is constructed of puncture resistant, polyethylene film and does not contain bisphenol-A. Biodegradable materials may also be used. The chambers may be formed by heat sealing the periphery of the bag. Various types of heat sealing are known to those of ordinary skill in the art, these include continuous heat-sealers (also known as Band type heat sealers), impulse heat sealers that use a stationary element which is heated with each sealing cycle, hot bar sealers, and ultrasonic welders. Other methods of manufacture will be apparent to those of ordinary skill in the art.

The loop may be welded to the container and may be perforated at intervals to allow adjacent bags to be separated from one another.

The plastic sheet 110 forming a corner of each of the bags may be removable so as to allow water to be removed from the chamber. The corner may be partially notched or slit to facilitate tearing off the corner.

The number of chambers may be varied. The chambers may be arranged in a strip, as shown, or in a two-dimensional array.

Figure 2:
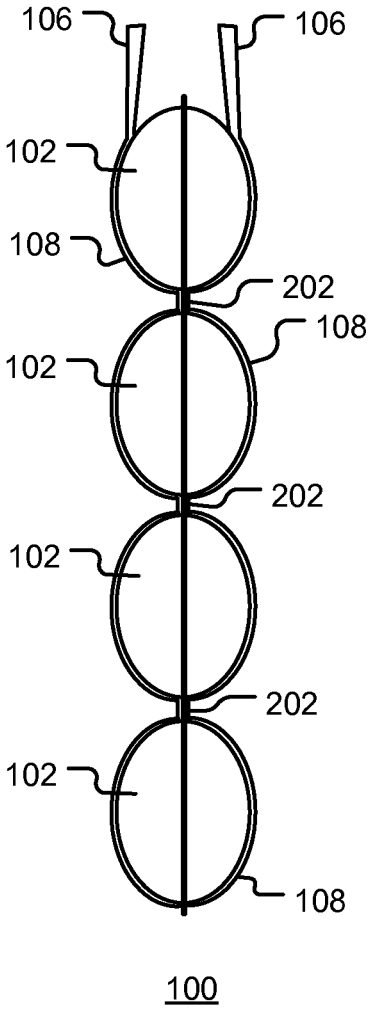
FIG. 2 is a second view of an exemplary water container in accordance with some embodiments of the invention.

FIG. 2 is an exemplary side view of the apparatus shown in FIG. 1. This view shows the chambers 102 for holding water (or ice). The chambers 102 are separated by a web of material 202 that is perforated so as to allow the chambers to be separated from one another. In this embodiment, the flexible loop includes a lower portion 108 that passes under the lower chamber and extends up both sides of the container to form carrying handle 106. In this embodiment the flexible loop is attached to all of its length apart from the carrying loops.

Figure 3:
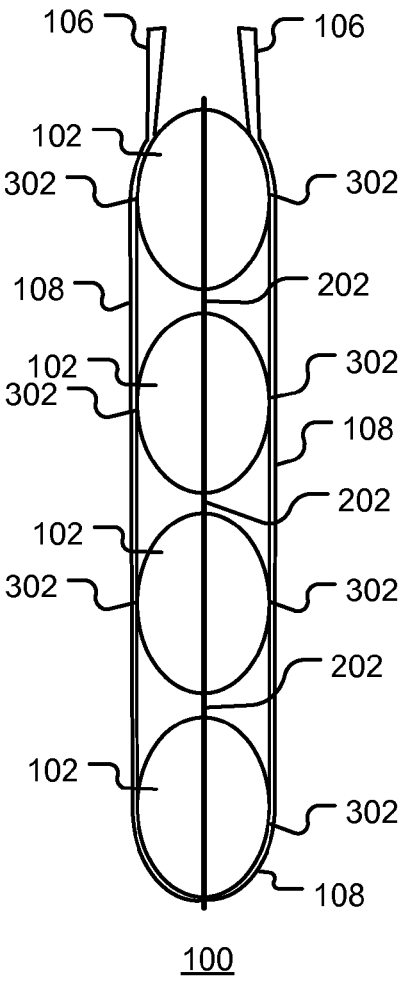
FIG. 3 is a further exemplary water container in accordance with some embodiments of the invention.

FIG. 3 shows a further embodiment in which the extension 108 of the flexible loop is attached to the container at intervals, such as discrete locations 302.

Figure 4:
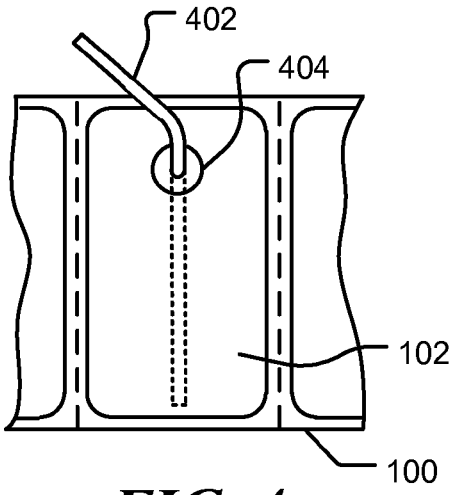
FIG. 4 shows an exemplary water container with a drinking straw in accordance with some embodiments of the invention.

FIG. 4 shows an embodiment in which a drinking straw 402 is embedded in a wall of each of the chambers 102. The straw 402 may have a valve or a snap-off end, so that water may be removed from the chamber through the straw when required. The region 404 of the chamber wall where the straw is embedded may be reinforced.

Figure 5:
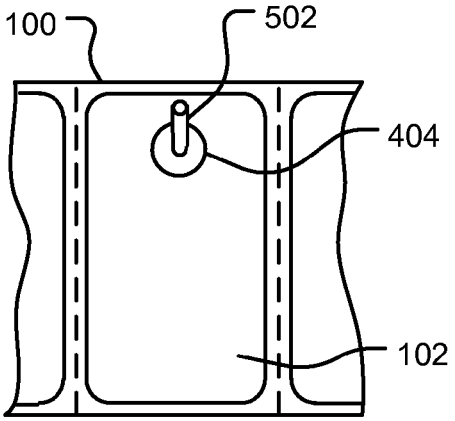
FIG. 5 shows an exemplary water container with a drinking nozzle in accordance with some embodiments of the invention.

FIG. 5 shows a further embodiment in which a nozzle 404 is embedded in wall of each of the chambers 102. The nozzle may be equipped with a cap or a valve, for example, to prevent unintended leakage, and may be re-sealable. The region 404 of the chamber wall where the nozzle is embedded may be reinforced. The valve may be a one-way valve that allows water to escape when the valve is pinched. The valve may be constructed of rubber or a rubber-like material.

The apparatus may be used for distributing water in liquid form or as ice. For example, when emergency relief is needed at a particular location there may be a need for both ice and water. Ice may be needed for a variety of reasons, included the preservation of perishable foods and for personal cooling. The apparatus of the present invention is well suited to this application.

Figure 6:
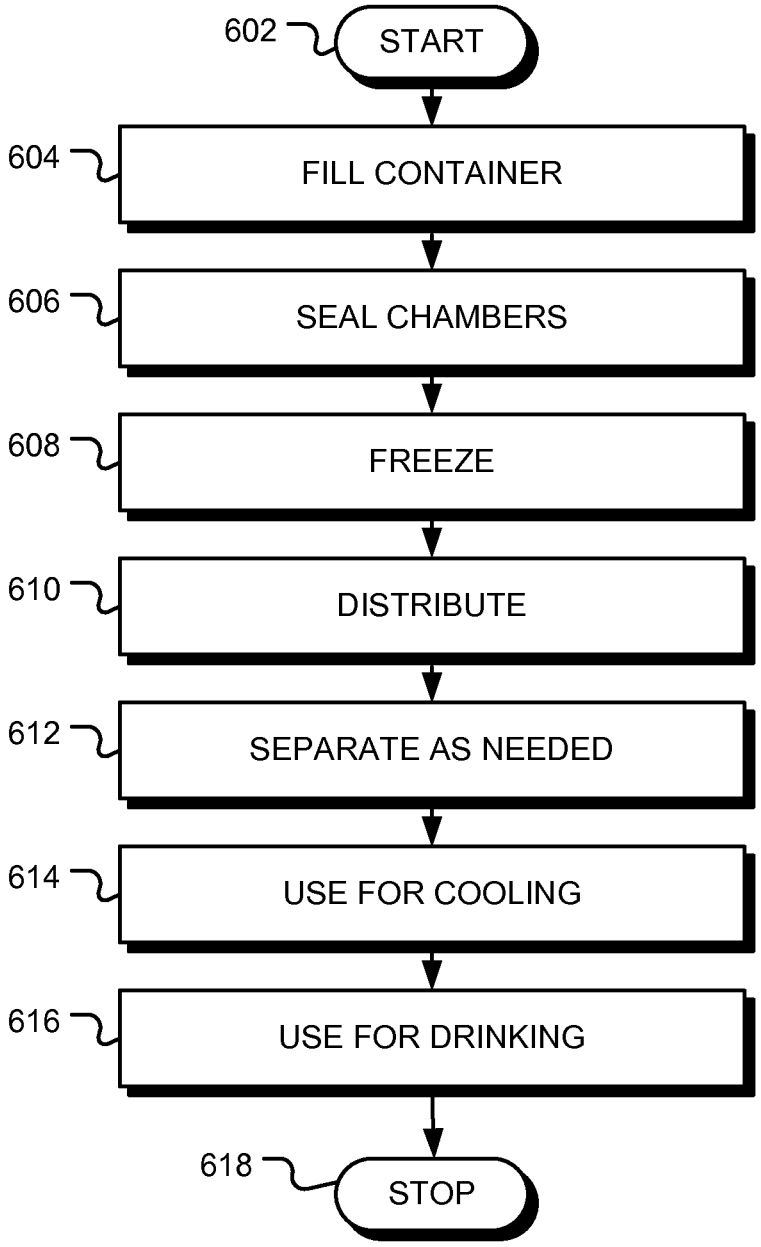
FIG. 6 is a flow chart of a method for water and ice distribution in accordance with some embodiments of the invention.

FIG. 6 is a flow chart of a method for water and ice distribution in accordance with some embodiments of the invention. Following start block 602 in FIG. 6, the chambers of the container are filled with potable water at block 604 and the chambers are sealed at block 606. At block 608, the water n the container is frozen. For example, this may be done before the container is transported to the region where emergency aid is required and distributed or while being transported in refrigerated vehicles, or at some other location. At block 610 the containers are distributed. They may be distributed complete, with multiple chambers and equipped with a carrying handle. Alternatively, one or more chambers may be separated prior to distribution. At block 612, the chambers are separated as needed by the user. Separation is facilitated by the perforations in the web separating the chambers. The ice may be used for cooling at block 614, such as for providing a cold compress if medically indicated. Once the ice has melted, the water may be used for drinking at block 616. In this way, both cooling and hydration needs are met. The method terminates at bock 618.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A method for distributing water in a container constructed from one of more flexible plastic sheets, the method comprising:

filling a plurality of chambers within the container with water, each chamber separated from an adjacent chamber by a web of the flexible plastic sheet;

sealing the water within the plurality of chambers;

freezing the water to form ice; and transporting the container;

wherein the web of the flexible plastic sheet is perforated to allow adjacent chambers to be separated from one another, where the plurality of chambers are arranged in a strip and adjacent chambers are coupled by a loop of flexible material that passes down a first side of the strip and continues up a second side of the strip to form a carrying handle when the strip is extended and to at least partially support the weight of water in any of the plurality of chambers, a length of the loop of flexible material is greater than a maximum extended length of the strip to form the carrying handle.

2. A method in accordance with claim 1, further comprising freezing the water within the plurality of chambers before transporting the container.

3. A method in accordance with claim 2, further comprising freezing the water within the plurality of chambers after transporting the container but before distributing the container.

4. A method in accordance with claim 1, wherein a drinking straw is embedded in a wall of each of the plurality chambers, to allow water to be removed from the chamber once the ice has melted.

5. A method in accordance with claim 1, wherein a drinking nozzle is embedded in a wall of each of the plurality chambers, to allow water to be removed from the chamber once the ice has melted.

6. A method in accordance with claim 1, wherein the flexible plastic sheet that forms a corner of each of the plurality chambers is removable to allow water to be removed from the chamber once the ice has melted.

7. A method in accordance with claim 1, where the loop of flexible material couples the plurality of chambers, said plurality of chambers comprising three or more immediately adjacent chambers and said loop of flexible material is configured to at least partially support the weight of water in any of the plurality of chambers when the strip is carried.

8. A method in accordance with claim 7, where the loop of flexible material couples to a face of the three or more chambers of the plurality of chambers.

9. A method in accordance with claim 1, further comprising:

removably attaching the loop of flexible material to the container.

10. A method in accordance with claim 1, where the loop of flexible material is perforated at intervals to allow adjacent chambers to be separated from one another.

* * * * *